US011434855B2

(12) United States Patent
Timme

(10) Patent No.: US 11,434,855 B2
(45) Date of Patent: Sep. 6, 2022

(54) BROAD-BAND RESONANCE SILENCER, IN PARTICULAR FOR A MOTOR VEHICLE ENGINE

(71) Applicant: Montaplast GmbH, Morsbach (DE)

(72) Inventor: Ralf Timme, Gärtringen (DE)

(73) Assignee: MONTAPLAST GMBH, Morsbach (DE)

( * ) Notice: Subject to any disclaimer, the term of this patent is extended or adjusted under 35 U.S.C. 154(b) by 0 days.

(21) Appl. No.: 16/956,548

(22) PCT Filed: Dec. 18, 2018

(86) PCT No.: PCT/EP2018/085587
§ 371 (c)(1),
(2) Date: Jun. 19, 2020

(87) PCT Pub. No.: WO2019/121744
PCT Pub. Date: Jun. 27, 2019

(65) Prior Publication Data

US 2021/0293210 A1 Sep. 23, 2021

(30) Foreign Application Priority Data

Dec. 20, 2017 (DE) ..... 10 2017 130 661.7

(51) Int. Cl.
*F02M 35/12* (2006.01)
*G10K 11/16* (2006.01)
*G10K 11/172* (2006.01)

(52) U.S. Cl.
CPC ..... *F02M 35/1266* (2013.01); *G10K 11/161* (2013.01); *G10K 11/172* (2013.01); *F02M 35/1261* (2013.01)

(58) Field of Classification Search
CPC ..... F02M 35/12; F02M 35/1266; F02M 35/1261; F02M 35/1277; F02M 35/1283; G10K 11/161; G10K 11/172
See application file for complete search history.

(56) References Cited

U.S. PATENT DOCUMENTS 4,953,660 A 9/1990 Jewell, Jr. et al.
5,979,598 A * 11/1999 Wolf ..... F02M 35/1216 181/272

(Continued)

FOREIGN PATENT DOCUMENTS

CN 1478994 A 3/2004
CN 107514325 A * 12/2017 ..... F02M 35/1266

(Continued)

OTHER PUBLICATIONS

Int'l Preliminary Report on Patentability dated Mar. 27, 2020 in Int'l Application No. PCT/EP2018/085587 (Translation).

(Continued)

*Primary Examiner* — Jeremy A Luks
(74) *Attorney, Agent, or Firm* — Panitch Schwarze Belisario & Nadel LLP

(57) ABSTRACT

A broad-band resonance silencer has an at least two-part housing which is designed to receive an exhaust-or gas-conveying pipe, which defines, with a circumferentially surrounding pipe jacket with acoustic openings formed therein, a pipe interior, wherein the pipe, in its installed position, is enclosed by a damping chamber formed by the housing, which chamber is actively connected to the pipe interior via the acoustic openings, and wherein the housing includes two axially split housing half-shells. In order to broaden the scope of use of such a broad-band resonance silencer, it is proposed that the pipe be designed as an insert which includes a central pipe section with two end-side pipe ends, that the insert be designed such that it can be inserted (Continued)

into the housing half-shells of the housing, and that the broad-band resonance silencer includes at least one acoustic channel.

20 Claims, 4 Drawing Sheets

(56) References Cited

U.S. PATENT DOCUMENTS

| | | | |
|---|---|---|---|
| 2005/0284692 | A1 | 12/2005 | McWilliam et al. |
| 2006/0032700 | A1 | 2/2006 | Vizanko |
| 2008/0230307 | A1 | 9/2008 | Matsumoto et al. |
| 2010/0193282 | A1 | 8/2010 | Kim et al. |

FOREIGN PATENT DOCUMENTS

| | | | | |
|---|---|---|---|---|
| DE | 19943246 | A1 * | 3/2001 | ..... F02M 35/1216 |
| DE | 10235408 | A1 | 2/2004 | |
| DE | 10 2006 017 154 | A1 | 11/2006 | |
| DE | 20 2005 012 036 | U1 | 12/2006 | |
| DE | 10 2010 022 780 | B4 | 2/2014 | |
| DE | 10 2015 202 851 | A1 | 8/2016 | |
| EP | 1 176 355 | A2 | 1/2002 | |
| EP | 2 009 272 | A2 | 12/2008 | |
| FR | 3042544 | A1 * | 4/2017 | ..... F02M 35/10006 |
| JP | 2014-152 651 | A | 8/2014 | |

OTHER PUBLICATIONS

Office Action dated Jul. 1, 2021 in Chinese Office Action 2018800822572 (no translation, shown for relevance).

Int'l Search Report dated Mar. 11, 2019 in Int'l Application No. PCT/EP2018/085587.

Int'l Preliminary Report on Patentability dated Mar. 27, 2020 in Int'l Application No. PCT/EP2018/085587.

Office Action dated Dec. 13, 2021 in Chinese Application No. 201880082257.

* cited by examiner

BROAD-BAND RESONANCE SILENCER, IN PARTICULAR FOR A MOTOR VEHICLE ENGINE

CROSS-REFERENCE TO RELATED APPLICATIONS

This application is a Section 371 of International Application No. PCT/EP2018/085587, filed Dec. 18, 2018, which was published in the German language on Jun. 27, 2019, under International Publication No. WO 2019/121744 A1, which claims priority under 35 U.S.C. § 119(b) to German Application No. 10 2017 130 661.7, filed Dec. 20, 2017, the disclosures of each of which are incorporated herein by reference in their entireties.

BACKGROUND OF THE INVENTION

The invention concerns a broad-band resonance silencer which is referred to hereinafter for simplicity as a broad-band silencer, in particular installed in an internal combustion engine, particularly preferably a motor vehicle engine, comprising an at least two-part housing, including in particular a housing lower shell and a housing upper shell. The housing has a silencer longitudinal axis and a silencer transverse axis and accommodates an exhaust gas-carrying or gas-carrying pipe which with a circumferentially surrounding pipe jacket with acoustic openings therein defines a pipe interior. The pipe forming an air passage in the installed position is enclosed by at least one damping or resonance chamber which is formed by the housing and which is operatively connected to the pipe interior by way of the acoustic openings, wherein the housing comprises axially divided two housing portions or is formed from same.

Vehicles which are becoming quieter and quieter also represent a major challenge in terms of automobile engineering, in particular the sound-intensive systems thereof, of which in particular the air induction system of the engine or a turbocharger thereof is affected. To minimise the generation of sound in an air induction system resonators are frequently used nowadays. A resonator generally comprises one or more chambers which are connected in gas-carrying relationship to an induction conduit for air. To achieve efficient sound damping and to cover a broad resonance spectrum a plurality of resonators can be provided in different configurations, which compensate for different resonance ranges.

As the parts of the induction system are nowadays frequently produced using injection moulding methods the developers are increasingly confronted with the problem of how a plurality of resonator chambers can be provided in the optimum fashion in a tight structural space.

Existing broad-band resonance silencers are predominantly in the form of multi-part systems or assemblies which are welded together and for example include outer housing portions into which pipe segments having openings are welded. What is noticeable with all existing solutions is the complexity of the shape configuration and the joining technology so that those systems frequently have to be welded as a multi-part structure. That is relatively complicated from the point of view of manufacturing technology and is also susceptible to faults. The complexity arising out of the state of the art increases manufacturing involvement and thus costs. Broad-band resonance silencers with resonators or resonance chambers subdivided by a plurality of separation walls require a relatively large amount of structural space and sometimes only have a small effective resonance volume. With those multi-part structures, a number of welding operations are usually required. Nested structures require interposed assembly steps in the welding procedure, which is also detrimental in regard to manufacturing costs. It is also difficult to implement different kinds and configurations of resonators in a broad-band resonance silencer and in that case at the same time to provide a large number of variants in a tight structural space.

The housing with the pipe arranged therein in the installed position form in the intermediate space between the inside tube and the outside housing, a damping system which extends along a system longitudinal axis or the silencer longitudinal axis, which axis however does not necessarily have to extend along a straight line, but can also be curved or bent. The individual damping chambers or resonance chambers are usually arranged to extend radially from the pipe in mutually spaced relationship along the longitudinal direction of extent of the silencer, of the overall system or damping system formed in that way.

Resonators of that kind are known for example from DE 10 2010 022 780 B4 and EP 1 176 355 A2 as well as DE 10 2015 202 851 A1, US 2008/230307 A1 and US 2005/284692 A1. US 2006/032700 A1 describes a broad-band resonance silencer having a plurality of resonance chambers separated by separation walls of a pipe insert body.

Disadvantages in the State of the Art

Although such broad-band resonance silencers already permit far-reaching absorption of the unwanted noises over a wide frequency spectrum the search is also on for possible ways of using them for even broader areas of use.

Technical Problem (Object)

Taking the above-mentioned state of the art as the basic starting point and the disadvantages involved therein the object of the invention is thus to at least partially avoid the stated disadvantages and in particular provide a noise silencer or broad-band resonance silencer for an internal combustion engine, which provides or permits a particularly broad spectrum of use for many frequencies and which even with a complicated geometry takes up as little space as possible and is easy to manufacture.

BRIEF SUMMARY OF THE INVENTION

That object is already attained by the features of the independent claims 1 and 20; preferred but not necessary developments are recited in the appendant claims.

In the simplest embodiment the pipe is in the form of a pipe insert body, that is to say a unit which is preferably formed in one piece and which includes the pipe or pipe connection or a pipe element which can be inserted into the housing portions in the installed position, wherein the pipe includes a plurality of acoustic openings in the pipe jacket surface and wherein the pipe insert body also includes end connections for connection to adjoining pipes, conduits or the like and at least one acoustic passage. The at least one or each acoustic passage respectively has a or precisely one passage inlet opening, through which the fluid or gas flows into same and is closed at the end in order therefore to function for example as a lambda/4 or lambda/2 passage.

Preferably the housing includes two portions, namely a first housing half-shell, in particular in the form of a housing lower shell, and a second housing shell which can be fitted thereonto and which in particular is in the form of a housing upper shell.

According to a first feature according to the invention the damping chamber is subdivided into at least two resonance chambers by way of at least one insert bar, wherein the at least one insert bar is provided on the insert body in one piece therewith and wherein the insert bar also functions as position fixing means. In combination with the first feature as a further feature the at least one acoustic passage includes an inlet opening which opens directly into the pipe. The insert bar and/or at least the passage inlet of the acoustic passage are thus also part of the preferably one-piece pipe insert body. Preferably at least partial regions of the at least one or more acoustic passages are also parts of the preferably one-piece pipe insert body. Particularly preferably at least partial regions of the at least one or more acoustic passages are part of the preferably one-piece pipe insert body and/or one or more complete acoustic passages are part of the preferably one-piece pipe insert body. If in relation to a given acoustic passage only a partial region thereof is part of the preferably one-piece pipe insert body then the other partial region of the respective acoustic passage, in order to complete same, is preferably formed by the housing or one of the housing portions. The respective 'partial region' of the acoustic passage is in that case a respective wall region of the acoustic passage, including the wall region which closes the passage end opposite to the passage inlet opening. The partial regions of a wall of an acoustic passage which are formed by the pipe insert body and a housing portion on the other hand are preferably welded together. That provides that the broad-band resonance silencer is particularly simple in structure and particularly easy to manufacture, more specifically by inserting the pipe insert body into one of the housing portions and closing or assembling the preferably two-part housing. At the same time the broad-band resonance silencer has improved sound damping as it includes a broad-band resonator and at the same time acoustic passages for additional and particularly effective damping of specific frequencies, wherein both damping functions are integrated on the pipe insert body.

The invention therefore provides a solution to the problem involved, namely besides broad-band damping by means of the at least one or more damping chambers, providing compensation for at least one or various frequencies by the at least one or more acoustic passages of differing lengths and differing geometries in a particularly small structural space in order in that way to compensate for or intercept at least one or various additional frequency ranges in the one or different acoustic passages corresponding to the frequencies, wherein the specific geometrical configuration of an acoustic passage or a plurality thereof, for example in length and diameter, can be determined by the man skilled in the art adapted to the frequencies to be compensated. In that way noises are compensated in a frequency range of any size, by virtue of a suitable configuration of the acoustic passage or a plurality thereof, in addition to the broad-band damping action. Preferred frequency ranges are between 200 and 800 Hz, in which respect however other frequency ranges also certainly lie in the area of the possible. Thus for example a given acoustic passage can be designed for the range of 200 Hz, an acoustic passage which is connected thereto or is separate can be designed for the frequency range of 300 Hz and a further acoustic passage can be designed for the frequency range of 400 to 600 Hz or even up to 800 Hz. According to the invention the acoustic passages, if there are a plurality thereof, are therefore of varying lengths and geometries to compensate or intercept the different frequency ranges.

The damping chamber can be subdivided by at least one insert bar into a plurality of resonance chambers or sub-chambers which for example are arranged to extend successively along the silencer longitudinal axis. The respective insert bar thus acts as a separation wall to separate the adjacent resonance chambers from each other. Separation of the resonance chambers by the respective insert bar is respectively effected at least substantially in gas-tight relationship, in which respect a low leakage rate in relation to a gas exchange between adjacent resonance chambers is acceptable if thereby the noise-damping function of the respective resonance chamber is not substantially impaired. The respective insert bar is preferably fixed to the pipe insert body or particularly preferably is formed in one piece thereon.

The broad-band resonance silencer in the form of an air duct system thus has two essential components, namely the external or accommodating housing and the pipe insert body which can be fitted therein. The pipe insert body includes the pipe which carries the fluid or air from a silencer inlet side to a silencer outlet side. Particularly preferably the broad-band resonance silencer including the further at least one acoustic passage and insert bars for separation of the resonance chambers comprises the housing shells and the pipe insert body, whereby the broad-band resonance silencer is particularly easy to manufacture. In addition this means that the broad-band resonance silencer, with a given configuration of the housing, can be adapted to different requirements of sound damping, for example differing designs of a turbocharger, precisely by using a different arrangement of the insert bars and/or different configurations of the at least one or more acoustic passages.

Generally in accordance with the invention therefore the housing can comprise more than two housing shell portions, in which respect for the sake of ease of reference the term 'housing half-shell' is also used instead of the term 'housing partial shell'. More specifically however the term 'housing half-shell' is intended to refer to a two-part housing with two housing half-shells.

The housing which is therefore preferably in two parts is preferably of a shell-shaped configuration and preferably includes a housing lower shell and a housing upper shell which can be joined together at a separation location or separation plane in the installed position, for example by welding, preferably extending along the silencer longitudinal axis.

The pipe insert body with the at least one inset bar extending with its longitudinal direction transversely relative to the silencer longitudinal axis and at least the partial regions of at least one or more acoustic passages is preferably in one piece, which is particularly advantageous in regard to production engineering and handling when assembling the broad-band resonance silencer. Optionally the pipe insert body can also be of a multi-part nature, if the individual portions thereof are assembled to form a coherent unit so that the pipe insert body can be handled as one component and fitted into the housing shell so that then the broad-band resonance silencer can be produced by assembly to the second housing shell.

Preferably the housing portions or shells are produced using injection molding and are sealingly or gas-tightly joined together by means of welding. The pipe insert body which can be fitted into and accommodated in the housing with the air passage or pipe is open at both ends and is of a cross-section necessary for the media to flow therethrough.

According to the invention the volume or housing interior formed between the housing and the pipe or air passage forms the broad-band resonator which can also be in the form of a 'Helmholtz resonator', which for compensation of or covering a frequency spectrum of the greatest width, can include a plurality of sub-chambers or resonance chambers which are subdivided by insert walls or insert bars on the insert body. The sealing integrity necessary for functioning between the resonance chambers which are preferably provided in succession in the longitudinal direction can be implemented for example by a groove-and-tongue connection. Preferably provided at the housing inside is at least one groove into which the at least one insert bar which functions as a separation wall between the resonator chambers can be inserted.

The at least one acoustic passage forms a further tubular resonance volume which for example can be in the form of a lambda/4 resonator.

The acoustic passage is preferably formed at least partially or completely by at least one passage wall formed on the outside of the pipe and which is preferably part of the pipe insert body. The acoustic passage preferably respectively extends directly from the pipe.

Preferably the passage wall of the acoustic passage is arranged externally on the pipe insert body and is preferably formed in one piece thereon.

The passage wall can extend in relation to the longitudinal direction of the passage in the longitudinal direction of the silencer, whereby the passage length can vary over relatively large ranges and can thus cover individual frequencies of a greater frequency spectrum. The passage wall can also extend transversely relative to the silencer longitudinal direction, in regard to the passage longitudinal direction, whereby the geometry of the passage extent can be varied over relatively great ranges. Particularly preferably the at least one acoustic passage has a portion which extends with its longitudinal extent in the direction of the silencer longitudinal axis and a portion which extends with its longitudinal extent along the silencer transverse axis so that the passage length and thus also the frequency damped by the passage can be selected from a wide frequency range and the silencer can be adapted to different requirements.

In that respect it is also possible for the acoustic passage to extend at least portion-wise in spaced relationship from the pipe jacket forming an intermediate space between the passage and the pipe. In that way the geometry of the longitudinal extent of the passage can be practically freely selected and the passage length can vary in a wide range and can be adapted to the respective requirements.

The pipe of the pipe insert body has a plurality of acoustic openings, wherein for a resonance chamber a respective plurality of acoustic openings can be provided on the pipe. The resonance chamber is respectively formed between the pipe and the housing, wherein adjacent resonance chambers are separated from each other by the insert bars. In relation to a respective resonance chamber a respective plurality of acoustic openings are provided on the pipe (preferably more than two) which are arranged distributed around the pipe circumference and/or a plurality of acoustic openings (preferably more than two) arranged spaced from each other in the longitudinal direction of the pipe. The number and/or size of the acoustic openings, that is to say their length, width and diameter, are individually determined according to the desired frequency ranges to be damped for each chamber.

To utilize the entire volume of the damping chamber the at least one acoustic passage can also extend over a plurality of resonance chambers, in which respect it can be of any desired geometries.

Preferably the at least one acoustic passage extends along the silencer longitudinal axis and/or along the silencer transverse axis, in particular in the edge region in the proximity of or adjoining the enclosing housing. Preferably the acoustic passage extends circumferentially along the edge of the pipe insert body and therefore substantially reproduces at a spacing the edge contour of the pipe insert body. It is however in principle in accordance with the invention for the at least one acoustic passage to be of any desired geometry for the respective situation of use, for example the geometry of a screw or spiral for particularly long acoustic passages.

In a preferred embodiment the acoustic passage includes at least one passage wall, passage rib or the like which extends radially from the pipe insert body, in particular being formed in one piece thereon, which can be connected in the installed position to the adjoining housing portion to form the acoustic passage, more specifically in particular by means of a sealing connection for closing the acoustic passage. Preferably that connection is made by means of glueing, welding or the like. In that way the pipe insert body only has to be fitted into the one housing shell with positioning of the separation wall and then closed with the second housing shell. The pipe insert body can be particularly easily produced in that way, in particular also in the form of an injection molding, more specifically also in the form of a one-piece component. The passage wall can also engage at the inside into a receiving groove of suitable configuration on the inside of the housing.

Embodiments also provide that the passage wall can additionally be welded to be sealingly closed off.

Thus a corresponding number of acoustic passages or resonator passages can be easily so provided in the given space by a plurality of passage walls which in particular extend in mutually parallel juxtaposed relationship.

The at least one or the respective acoustic passages or resonator passages each have at least one or precisely one passage opening or passage inlet opening, through which an air flow or sound wave can pass from the pipe into the respective passage and is or are respectively closed at the end opposite to the passage inlet.

Different lengths of those acoustic passages and a differing geometrical configuration thus make it possible to compensate for different frequency spectra. The configuration of the passage opening in the form of a slot has proven to be particularly desirable, in which case in principle the inlet opening corresponds to the cross-section of the acoustic passage.

In general the cross-section and the length of the acoustic passage are adapted to the frequency to be compensated. The acoustic passages can be for example in the form of a lambda/4 passage or resonator or a lambda/2 passage or resonator. With a lambda/4 passage the acoustic passage has one-quarter of the wavelength to be damped so that when a sound wave passes through to the passage end and back this involves lambda/4 and thus the wave in question is damped in the pipe by superimposition of the waves. As the sound frequencies covered depend on the respective length of the acoustic passage the acoustic passages formed in that way can be of different lengths.

Preferably the outer acoustic passages which therefore extend closer to the housing wall are larger and are therefore of a greater length because they are relatively further away from the pipe of the insert body.

Embodiments include the configuration of the acoustic passage in adjoining relationship with the outer jacket surface of the pipe but also spaced from said surface so that they therefore do not have to bear directly against the pipe jacket surface.

The configuration according to the invention, as a particular advantage, gives a saving in weight and cost as well as a substantial simplification in the manufacturing process. The design configuration of the pipe with the various passages and ribs in the form of a pipe insert body provides for particularly easy assembly which also implements the fitment of a plurality of resonators involving different modes of operation in a simple system unit or assembly.

The broad-band resonance silencer according to the invention preferably comprises plastic and is preferably manufactured using an injection molding process, that is to say in the form of a multi-part injection molding.

The broad-band resonance silencer in that respect includes a plurality of and preferably two housing portions which can be connected together at a joining location to form an interior, in particular being in the form of housing half-shells which can be separated in the transverse direction of the system, that is to say radially, and include between them the gas-carrying pipe with an inlet and an outlet end at the ends thereof as well as a plurality of acoustic openings in the pipe jacket.

The at last one acoustic passage is formed by an in particular continuous passage wall which is provided between the outer circumferential surface of the pipe insert body and the housing which receives it or encloses it circumferentially in the installed position, which passage wall is preferably formed in one piece at the outside of the pipe insert body in the form of a projecting bar, being therefore closed in the installed position by the inner surface or wall of the housing.

Preferably the at least one passage wall is provided on the pipe insert body, for example being formed in one piece thereon. It is however also in accordance with the invention for the configuration to be reversed, that is to say with the passage wall being provided at the inner surface of the housing or the housing portions, which in the installed position then fits on the outer surface of the pipe insert body and thus defines the circumferentially extending acoustic passage.

To cover or compensate for different resonance ranges embodiments include a plurality of such passage walls which are provided in mutually displaced spaced relationship at the outside surface between the pipe insert body and the housing and which are thus operative for different frequency ranges. Those acoustic passages which are thus formed by the passage walls thus form further individual acoustic chambers which can therefore be designed as desired for the noises to be influenced or the oscillations to be compensated.

Embodiments include at least one separation wall or passage separation wall or boundary walls arranged in the acoustic passage or passages, which can limit the passage length as required to compensate for given frequencies. The passage separation or boundary walls can also be adapted to be subsequently inserted, for example in the form of a tongue-and-groove connection between the two components.

To enlarge the resonance spectrum to be processed embodiments provide various acoustic passages in various planes which can be connected together by way of a connecting passage, thus for example acoustic passages provided above or below each other in the silencer longitudinal direction.

Embodiments provide that the acoustic passages can be provided on different planes in displaced relationship in respect of height relative to the central longitudinal axis of the damping system, preferably in the form of circumferentially closed damping or acoustic passages. In accordance with the invention the damping system comprises housing and pipe insert body.

The individual acoustic passages preferably extend substantially transversely relative to the longitudinal direction of the system and are preferably provided circumferentially, for example substantially in a plane extending on the pipe insert body, in which respect however individual acoustic passages can be provided on different planes on the pipe insert body. Thus for example a first acoustic passage which is thus an upper passage in the installed position can include an acoustic passage which is provided on the top side of the pipe insert body and which opens by way of a connecting passage extending downwardly in particular transversely relative to the longitudinal direction of the system into a second lower acoustic passage which for example is provided circumferentially at the outer edge of the pipe insert body.

To enlarge the geometrical configuration options in a tight available space an acoustic passage can also have a blind hole which extends vertically downwardly or upwardly or from a first acoustic passage to a second acoustic passage which is arranged in displaced relationship in respect of height in relation to that first acoustic passage, wherein same preferably extends substantially transversely relative to the longitudinal direction.

That blind hole can function as a connecting passage between two acoustic passages or acoustic passage portions which for example are provided on different planes in the broad-band resonator. A still further differentiation or frequency absorption in a tight space can be achieved if an acoustic passage or a further acoustic passage is provided in at least one connecting region of a pipe end. Preferably that acoustic passage is in the form of a circular ring space which particularly preferably is provided in or at a pipe connection of the broad-band resonance silencer. That pipe connection is particularly preferably formed in one piece on the housing.

Embodiments provide between the joint partners, that is to say the insert body and the housing, position fixing means, for example in the form of insert bars on one component, which in the installed position engage into internal grooves on the corresponding other component and which thus ensure more accurate positioning of the insert body in the housing. The bars can be for example in the form of plates secured to the insert body, preferably being formed integrally thereon. Vibrations and oscillations of the bars in operation of the silencer are also prevented by the position fixing means between the insert bar and the housing. In general the insert bars end at least substantially gas-tightly with the housing interior. The 'installed position', as also generally in accordance with the invention, respectively relates to the position of the respective component in the broad-band resonance silencer when ready for use.

Preferably the broad-band resonance silencer includes a pipe connection at the inlet end in the flow direction and a pipe connection at the outlet end in the flow direction, for connection to the media-carrying conduits. Preferably those pipe connections are formed on the housing, more specifically in the form of connecting unions in the form of a circular ring, on to which the connecting pipes can be fitted.

At the inlet end of an acoustic passage, at the flow side, inlet openings can be provided in the pipe jacket surface of the insert body. At its inlet end therefore the respective acoustic passage has an inlet opening provided in the pipe jacket surface of the pipe of the insert body. The acoustic passage therefore respectively directly adjoins the pipe of the pipe insert body. The acoustic passage therefore extends with its passage wall directly from the pipe. The at least one or more inlet openings can be in particular in the form of slots and are preferably adapted to the size of the acoustic passage, being therefore approximately as large as the cross-section of the acoustic passage.

At its end opposite the inlet opening the respective acoustic passage is closed so that the sound wave passing into the passage is reflected back into the pipe at the passage end. The passage is therefore in the nature of a lambda/4 passage. The acoustic passage therefore has a closed and interruption-free side wall over its entire length, which is therefore at least substantially or practically completely gas-tight except for the inlet opening of the passage. If the passage wall is formed by two components, for example the pipe insert body and the housing or a housing portion, then those components are at least substantially gas-tightly assembled, particularly preferably by welding.

Embodiments provide that an acoustic passage is subdivided into two acoustic passage portions by at least one separation wall extending transversely relative to the longitudinal axis of that acoustic passage. Preferably those separation walls, for particularly simple adaptation to the respective situation of use, that is to say for simple adaptation of the length of the acoustic passage, can be inserted in connected relationship at different locations to the acoustic passage, for example for compensation of different frequencies.

The broad-band resonance silencer according to the invention is preferably arranged between a turbocharger and an air filter housing of an internal combustion engine to compensate for unwanted resonances.

In addition the invention concerns an internal combustion engine having a broad-band resonance silencer as described hereinbefore.

In the specific description hereinafter reference is made to the accompanying drawings which form a part of this description of the invention and which for illustration purposes show specific embodiments with which the invention can be carried into effect. In this respect directional terminology like for example "upward", "downward", "forward", "rearward", "front", "rear" and so forth is used in relation to the orientations of the described Figure or Figures. As components of embodiments can be positioned in a number of differing orientations the directional terminology serves for illustration and is in no way limiting. It will be appreciated that other embodiments can be used and structural or logical modifications can be made without thereby departing from the scope of protection of the present invention. The following description is not to be interpreted in a limiting sense.

In the context of this description the terms "connected", "joined" and "integrated" are used to describe both a direct and also an indirect connection. Identical or similar components are denoted by identical references in the Figures insofar as that is desirable.

Reference numeral lines join the reference numeral to the part in question. An arrow in contrast which does not touch any part relates to an entire unit towards which it is directed. The Figures moreover are not necessarily true to scale. To illustrate details certain regions are possibly shown on an exaggeratedly large scale. In addition the drawings can be simplified for improved clarity and do not contain every detail which is possibly present in a practical configuration. The terms "upward" and "downward" relate to the view in the Figures.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
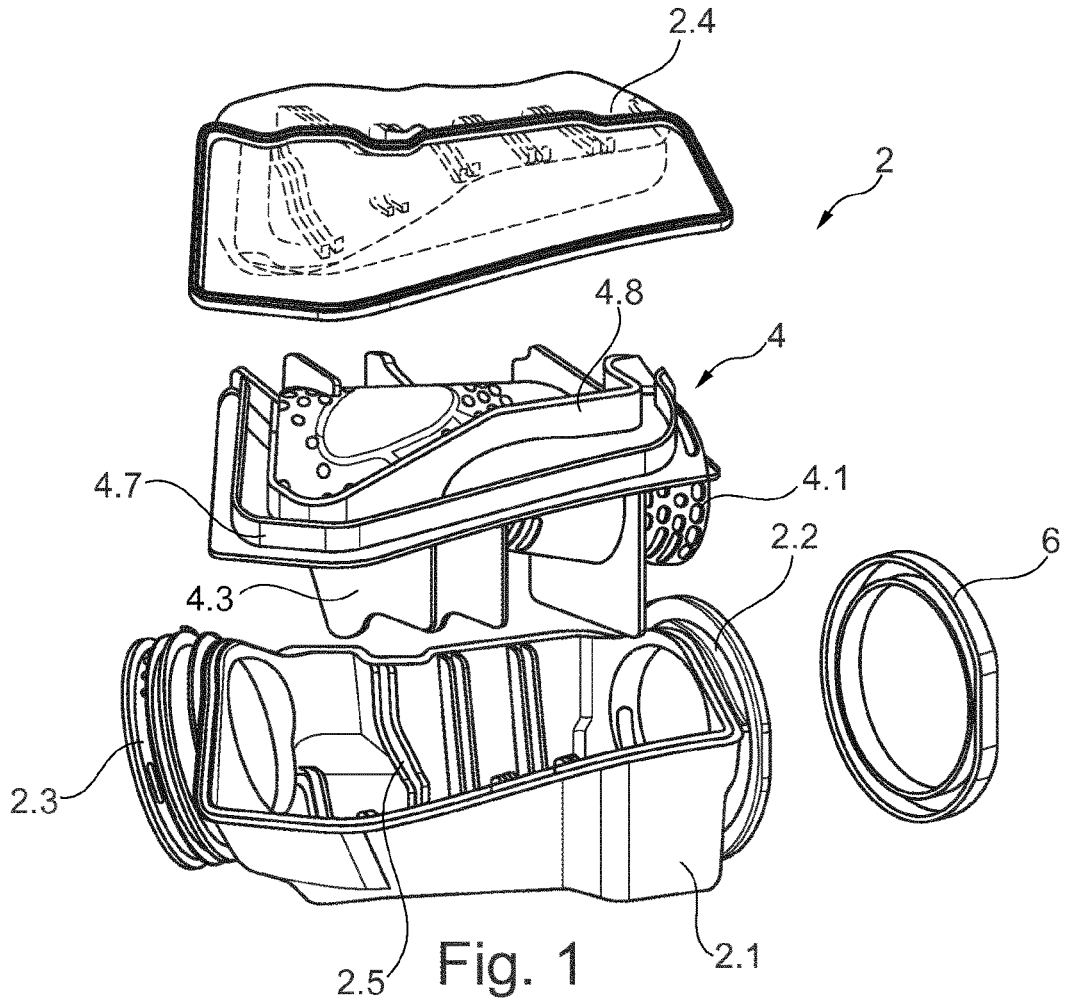
FIG. 1 shows an isometric exploded view longitudinally of the broad-band resonance silencer according to the invention.

Accordingly the broad-band resonance silencer includes substantially a two-part housing 2 in the form of a plastic injection molding for insertion or receiving the pipe insert body 4. Optionally however the housing can also comprise more than two half-shells.

In the present embodiment the broad-band resonance silencer includes a two-part housing 2 having a silencer longitudinal axis and a silencer transverse axis, an exhaust gas-carrying or gas-carrying pipe 4.1 which is accommodated in the housing and which with a circumferentially surrounding pipe jacket with acoustic openings therein defines a pipe interior, wherein the pipe 4.1 in the installed position is enclosed by at least one damping chamber formed by the housing, being operatively connected to the pipe interior by way of the acoustic openings 4.2. In the present case the housing 2 includes two housing portions in the form of two housing half-shells 2.1, 2.4. According to the invention in all embodiments the pipe 4.1 is in the form of a pipe insert body 4 including a central pipe portion with two front pipe ends. The insert body 4 is designed to be inserted into the housing portions of the housing and the broad-band resonance silencer has at least one acoustic passage 2.6, 4.5, 4.6, 4.13, 4.15, 4.20. In addition the damping chamber is subdivided by way of at least one insert bar 4.3 into at least two resonance chambers and the at least one insert bar 4.3 is provided on the insert body 4 in one piece therewith. The insert bar 4.3 also functions as a position fixing means. Finally the at least one acoustic passage includes an inlet opening 4.11, 4.12 provided in the pipe insert body.

The housing 2 includes a substantially trough-shaped housing lower shell 2.1 having a central receiving region for receiving the pipe insert body 4, into which therefore the pipe insert body 4 can be inserted in such a way that the pipe ends of the pipe 4.1 of the pipe insert body 4 end with the pipe connections 2.2, 2.3 of the housing lower shell 2.1, which connections are in the form of connecting unions and are in one piece.

The housing lower shell 2.1 can be media-tightly closed by way of a housing upper shell 2.4 of a roof-shaped configuration, for which purpose the housing lower shell 2.1 in the outer edge region has a circumferential closed insertion groove 2.5 into which a sealing bar of complementary configuration on the housing upper shell 2.4 engages in media-tight relationship in the installed position.

The pipe insert body 4 therefore includes a central pipe 4.1 which extends along the longitudinal axis and which includes an outer pipe jacket surface, in which a plurality of acoustic openings 4.2 (only one thereof is provided with a reference numeral) are provided in circumferentially distributed relationship at various locations.

In addition the pipe insert body 4 at the lower end includes radially projecting insert bars 4.3 (only one is denoted by a reference numeral) which are spaced from each other in the longitudinal direction and extend transversely relative to the longitudinal direction of the system and which in the installed position can be inserted into insertion grooves 2.5 (only one is denoted by a reference numeral) provided at the inside on the housing lower shell 2.1. This ensures that the pipe insert body 4 is fixed in the desired position in the installed position within the housing 2 because therefore the insert bars 4.3 engage into the grooves 2.5 to fix the position and thus also terminate the ends of the pipe 4.1 of the pipe insert body 4 with the inside of the pipe connections 2.2, 2.3 of the housing lower shell 2.1 in media-carrying relationship.

In general however it is also possible to provide only one such insert bar so that the silencer therefore has only two resonance chambers.

Figure 2:
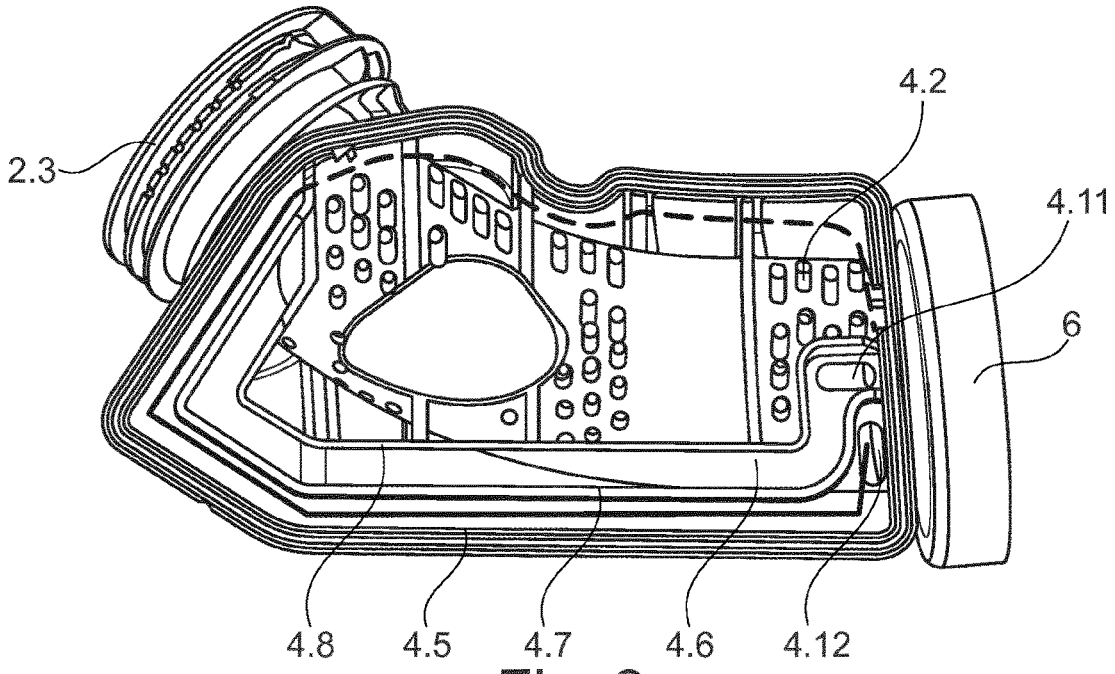
FIG. 2 shows an isometric plan view of the broad-band resonance silencer with the upper half-shell removed.
Figure 3:
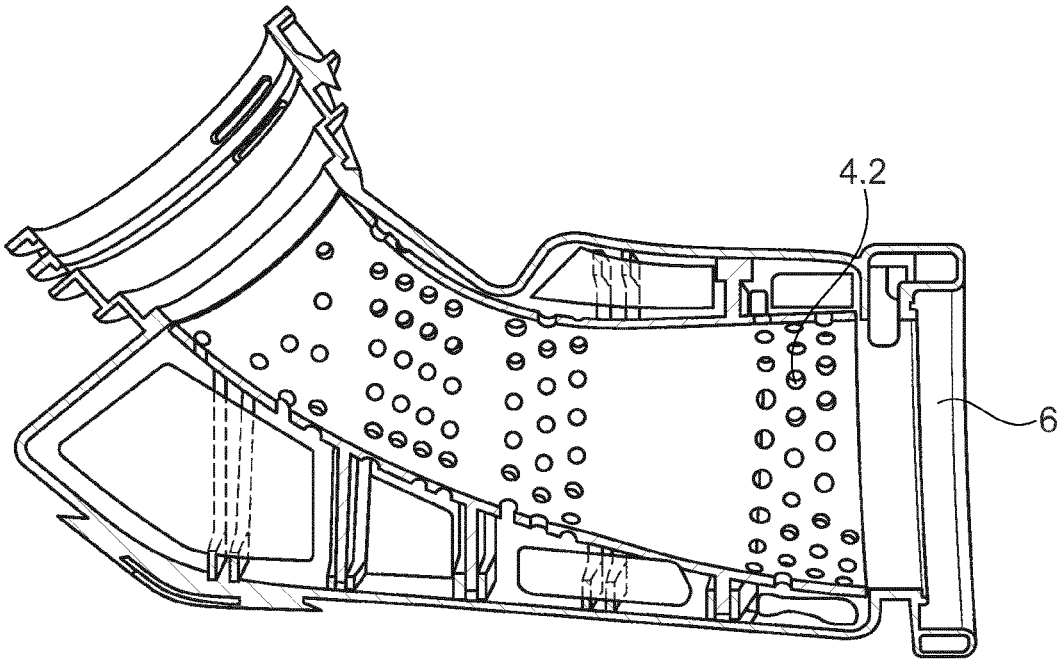
FIG. 3 shows a longitudinal section of the broad-band silencer shown in FIG. 2.

Referring to FIGS. 1 and 2 provided on the top side of the pipe insert body are two acoustic passages 4.5, 4.6, more specifically an outer acoustic passage 4.5 and an inner acoustic passage 4.6 which are formed by passage walls 4.7, 4.8 which project radially in one piece at the outside of the pipe 4.1 of the pipe insert body 4 and which extend relative to the outer edge of the pipe insert body 4 in mutually spaced relationship circumferentially along the edge in such a way that provided therefore between them and the surrounding housing 2 in radially spaced relationship are the circumferential acoustic passages 4.5, 4.6 which in the present case are of approximately the same width, of which however the inner acoustic passage is correspondingly shorter.

In general however there can also be only one acoustic passage or more than two.

Besides the actual acoustic openings 4.2 the pipe insert body 4 therefore includes at the right-hand proximal inlet end in the Figures inlet openings 4.11, 4.12 in the form of slots 2.7 for the acoustic passages, through which the medium can pass from the pipe interior into the respective acoustic passage 4.5, 4.6 and issue again therefrom.

Figure 4:
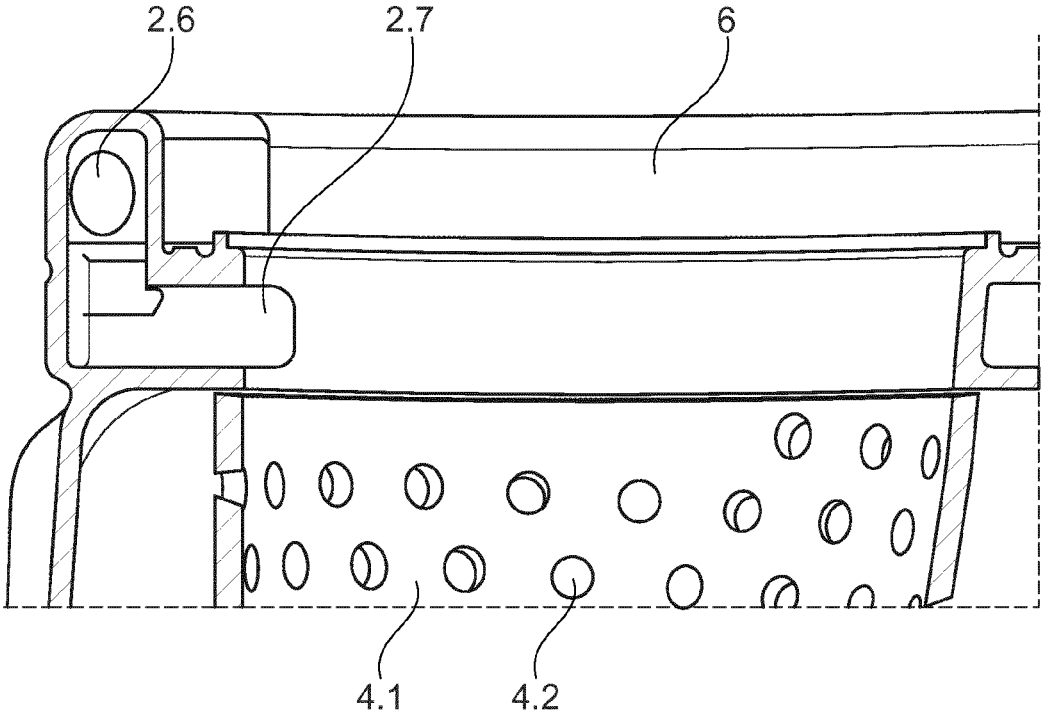
FIG. 4 shows an enlarged view of the inlet end at the right-hand side in FIGS. 1 to 3 of the broad-band resonance silencer.
Figure 5:
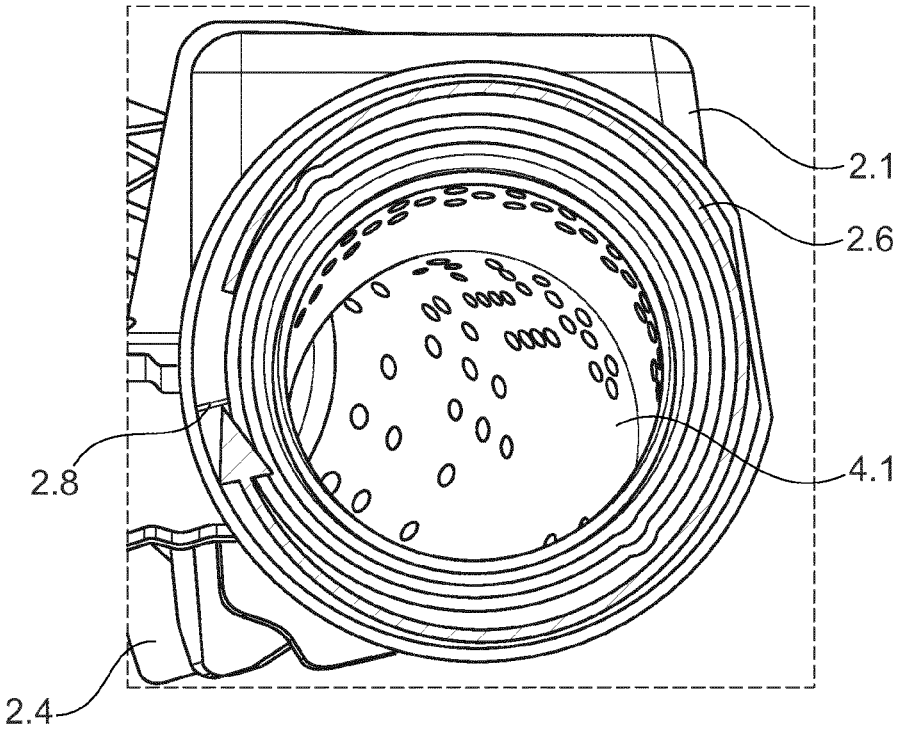
FIG. 5 shows an isometric end cross-section of the inlet end of the broad-band resonance silencer.

As can be seen in particular from the enlarged views of the pipe connection 2.2 in FIGS. 4 and 5 circumferentially extending acoustic passages 2.6 can be provided in pipe connections 2.2, 2.3, which connections therefore form an annular space circumferentially surrounding the pipe connection 2.2, which is formed on the inside by the pipe connection 2.2, and in which there is provided an inlet opening also in the form of a slot 2.7, and externally by a ring fitment 6 which can be snap-fitted on to the pipe connections 2.3, 2.4 in such a way that further acoustic passages can be formed between the ring fitment 6 and the pipe connection 2.2, 2.3 around the pipe connections 2.2, 2.3.

A separation wall 2.8 which is inserted into that acoustic passage 2.6 and extends transversely relative to the longitudinal direction thereof defines the length of the acoustic passage 2.6.

Figure 6:
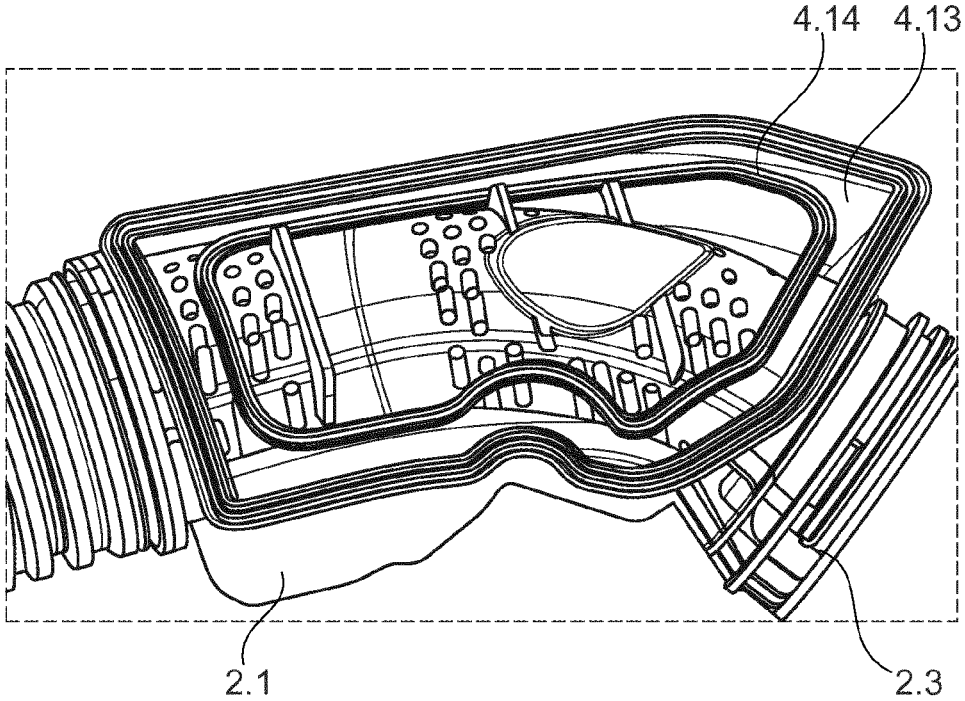
FIG. 6 shows the broad-band resonance silencer of FIG. 1 in the installed position with the upper half-shell removed to show the main acoustic passage.

In the alternative configuration shown in FIG. 6 provided on the pipe insert body 4 is only one circumferential acoustic passage 4.13 formed by a circumferential passage wall 4.14.

Figure 7:
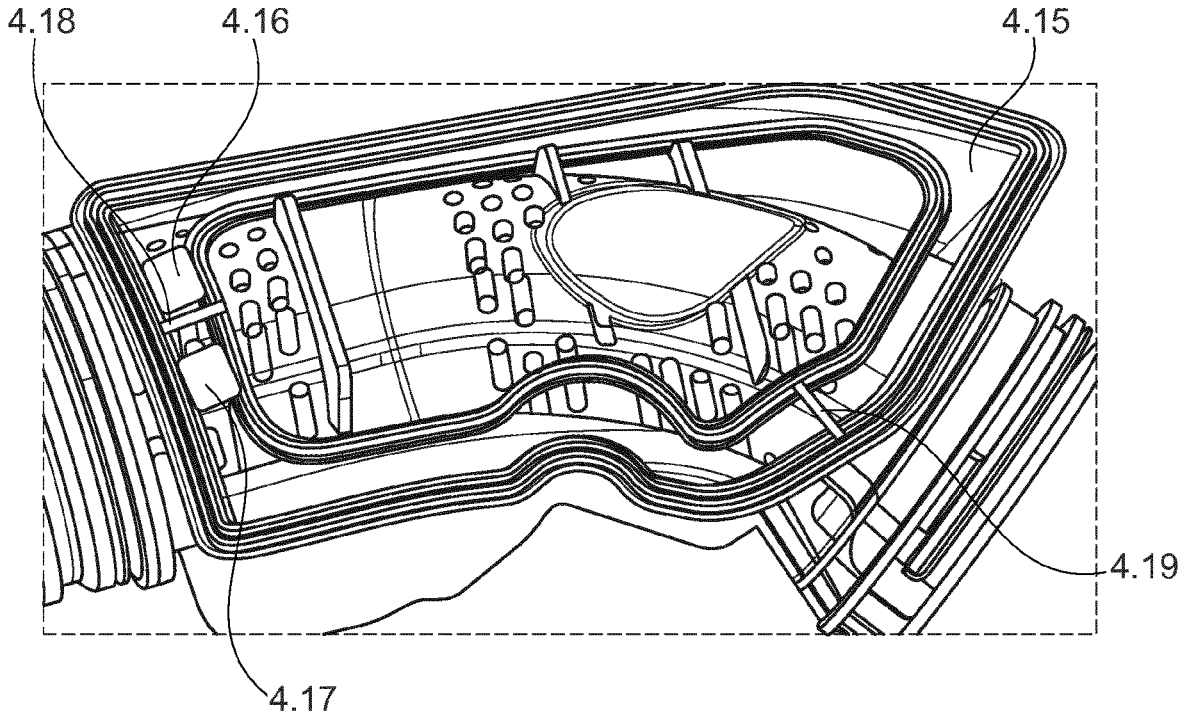
FIG. 7 shows the view of FIG. 6 with separation walls fitted into the main acoustic passage.

The further embodiment shown in FIG. 7 also has only one circumferential acoustic passage 4.15 on the outer surface of the pipe insert body 4. This however is of a two-part configuration and includes two inlet openings in the form of slots 4.16, 4.17 which are separated from each other by an insertable separation wall 4.18 at the inlet end and are separated from each other at the end by a further separation wall 4.19. In that way the portion of the acoustic passage 4.15 which is the lower portion in FIG. 7 is however only approximately half as long as the portion of the acoustic passage 4.15 which is the upper portion in FIG. 7. That pipe insert body 4 can be particularly easily adapted to different frequency ranges by re-fitment of the separation wall 4.19 at different locations.

Figure 8:
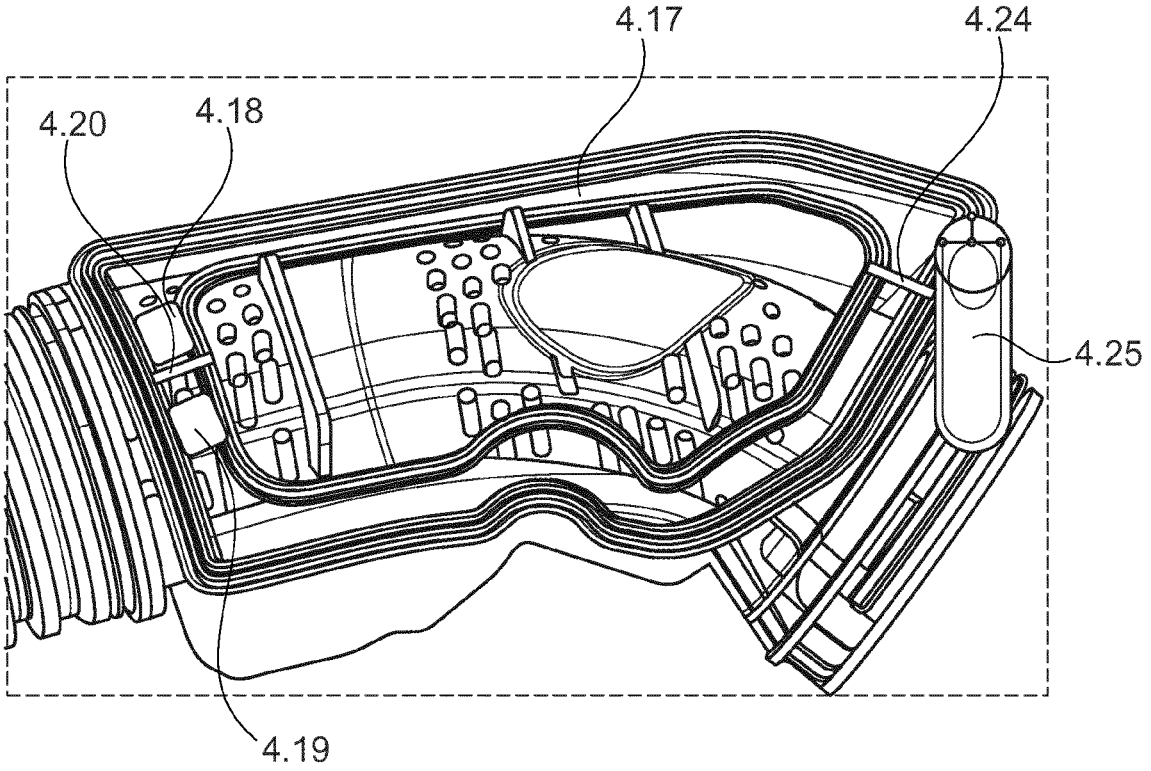
FIG. 8 illustrates an alternative embodiment of the broad-band resonance silencer with acoustic passages provided on different planes.

Finally FIG. 8 shows an isometric plan view of an embodiment of a broad-band resonance silencer with an acoustic passage 4.20 which is in part provided on two planes and which again includes a plurality of acoustic passage portions. The upper planes visible in FIG. 8 of the two acoustic passage portions each have an associated inlet opening in the form of a slot 4.21, 4.22 and a separation wall 4.23 therebetween. Those acoustic passage portions are again defined by a separation wall 4.24 which ends the two portions.

In addition this embodiment includes a diagrammatically indicated blind hole 4.25 which extends vertically, that is to say transversely relative to the longitudinal direction, and which represents a prolongation for the compensation of further frequencies. In a further embodiment this blind hole can be fluidically connected to a concealed acoustic passage portion arranged therebeneath, which permits further design configuration options for frequency compensation on an extremely limited structural space.

The subject of the present invention is afforded not only by the subject-matter of the individual claims but the combination of the individual claims with each other. All features and details disclosed in the documents, including the Abstract, in particular the spatial configuration shown in the drawings, are claimed as being essential to the invention insofar as they are novel individually or in combination over the state of the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A broad-band resonance silencer comprising an at least two-part housing (2) which defines a silencer longitudinal axis and a silencer transverse axis, an exhaust gas-carrying or gas-carrying pipe (4.1) which is accommodated in the housing and which with a circumferentially surrounding pipe jacket with acoustic openings therein defines a pipe interior, wherein the pipe (4.1) in the installed position is enclosed by at least one damping chamber which is formed by the housing and which is operatively connected to the pipe interior by way of the acoustic openings (4.2), wherein the housing (2) comprises at least two housing portions, in particular two divided housing half-shells (2.1, 2.4), wherein the pipe (4.1) is in the form of a pipe insert body (4) which includes a central pipe portion with two front pipe ends, wherein the pipe insert body (4) is adapted to be inserted into the housing portions of the housing (2), wherein the damping chamber is subdivided into at least two resonance chambers by way of at least one insert bar (4.3), wherein the broad-band resonator can also be in the form of a Helmholtz resonator, wherein the at least one insert bar (4.3) is provided on the insert body (4) in one piece therewith, wherein the insert bar (4.3) also functions as a position fixing means for the pipe insert body in relation to the housing, wherein in addition to the broad-band resonator at least one acoustic passage (4.5, 4.6, 4.11, 4.12, 4.13, 4.15, 4.20) providing a tubular resonator volume is provided, the passage inlet opening (4.11, 4.12) of the acoustic passage is provided in the pipe insert body, and the acoustic passage (i) extends at least portion-wise spaced from the pipe jacket forming an intermediate space between the passage (4.5, 4.6, 4.11, 4.12, 4.13, 4.15, 4.20) and the pipe (4.1), and/or (ii) extends in the direction of the silencer longitudinal axis over a plurality of damping chambers.

2. A broad band resonance silencer according to claim 1 wherein the acoustic passage (4.11, 4.12) extends with its longitudinal extent at least portion-wise in the direction of the silencer longitudinal axis.

3. A broad band resonance silencer as set forth in claim 1 wherein the acoustic passage (4.11, 4.12) extends with its longitudinal extent at least portion-wise along the silencer transverse axis.

4. A broad-band resonance silencer as set forth in claim 1 wherein the acoustic passage (4.11, 4.12) is arranged in a portion of its longitudinal and/or transverse extent at a spacing relative to the pipe jacket.

5. A broad-band resonance silencer as set forth in claim 1 wherein the acoustic passage (4.11, 4.12) is arranged in a portion of its longitudinal and/or transverse extent at the housing inside wall.

6. A broad-band resonance silencer as set forth in claim 1 wherein the at least one acoustic passage extends in the edge region in the proximity of or adjoining the surrounding housing.

7. A broad-band resonance silencer as set forth in claim 1 wherein the acoustic passage has an end which is opposite to the inlet opening and which is at least substantially closed.

8. A broad-band resonance silencer as set forth in claim 1 wherein the acoustic passage passes through at least one insert bar (4.3) of the insert body and is preferably formed integrally on the insert bar.

9. A broad-band resonance silencer as set forth in claim 1 wherein at least one passage wall portion of the acoustic passage (4.5, 4.6) is provided by a partial region of the pipe insert body (4) and/or a partial region of the housing (2).

10. A broad-band resonance silencer as set forth in claim 1 wherein the acoustic passage at least with a partial region thereof is part of the insert body.

11. A broad-band resonance silencer as set forth in claim 1 wherein the passage wall of the acoustic passage (4.7, 4.8) is provided with a partial region on the insert body and with another partial region on the housing (2), wherein the two partial regions together form the respective acoustic passage.

12. A broad-band resonance silencer as set forth in claim 1 wherein the at least one passage wall (4.7, 4.8) is provided circumferentially on the pipe insert body (4).

13. A broad-band resonance silencer as set forth in claim 1 wherein a further acoustic passage (4.5, 4.6) is provided at least one pipe connection (2.2, 2.3).

14. A broad-band resonance silencer as set forth in claim 1 wherein the inlet opening (4.11, 4.12) or passage opening is larger than the other acoustic openings.

15. A broad-band resonance silencer as set forth in claim 14 wherein the inlet opening (4.11, 4.12) or passage opening and the cross-section of the acoustic passage are of substantially the same geometry, in particular the same cross-section.

16. A broad-band resonance silencer as set forth in claim 1 wherein the acoustic passage (4.5, 4.6) includes a passage separation wall (4.18, 4.19, 4.23, 4.24).

17. A broad-band resonance silencer as set forth in claim 1 wherein a passage separation wall (4.18, 4.19, 4.23, 4.24) can be inserted into the acoustic passage.

18. A broad-band resonance silencer as set forth in claim 17 wherein the passage separation wall (2.8, 4.23, 4.24) is adapted to be insertable at different locations in the acoustic passage (4.5, 4.6).

19. An engine or turbocharger of an internal combustion engine with a broad-band resonance silencer as set forth in claim 1 in the air guide system, in particular air induction system, of same.

20. A method of noise damping using a broad-band resonance silencer or an engine or turbocharger of an internal combustion engine having the broad-band resonance silencer, wherein in addition to broad-band damping the at least one or each acoustic passage has a or precisely one passage inlet opening, through which the fluid or gas flows thereinto and is closed at the end to function as a lambda/4 passage or a lambda/2 passage, and wherein the broad-band resonance silencer comprises an at least two-part housing (2) which defines a silencer longitudinal axis and a silencer transverse axis, an exhaust gas-carrying or gas-carrying pipe (4.1) which is accommodated in the housing and which with a circumferentially surrounding pipe jacket with acoustic openings therein defines a pipe interior, wherein the pipe (4.1) in the installed position is enclosed by at least one damping chamber which is formed by the housing and which is operatively connected to the pipe interior by way of the acoustic openings (4.2), wherein the housing (2) comprises at least two housing portions, in particular two divided housing half-shells (2.1, 2.4), wherein the pipe (4.1) is in the form of a pipe insert body (4) which includes a central pipe portion with two front pipe ends, wherein the pipe insert body (4) is adapted to be inserted into the housing portions of the housing (2), wherein the damping chamber is subdivided into at least two resonance chambers by way of at least one insert bar (4.3), wherein the broad-band resonator can also be in the form of a Helmholtz resonator, wherein the at least one insert bar (4.3) is provided on the insert body (4) in one piece therewith, wherein the insert bar (4.3) also functions as a position fixing means for the pipe insert body in relation to the housing, wherein in addition to the broad-band resonator at least one acoustic passage (4.5, 4.6, 4.11, 4.12, 4.13, 4.15, 4.20) providing a tubular resonator volume is provided, the passage inlet opening (4.11, 4.12) of the acoustic passage is provided in the pipe insert body, and the acoustic passage (i) extends at least portion-wise spaced from the pipe jacket forming an intermediate space between the passage (4.5, 4.6, 4.11, 4.12, 4.13, 4.15, 4.20) and the pipe (4.1), and/or (ii) extends in the direction of the silencer longitudinal axis over a plurality of damping chambers.

* * * * *